US012538981B1

(12) United States Patent
Carrick

(10) Patent No.: US 12,538,981 B1
(45) Date of Patent: Feb. 3, 2026

(54) LEG REINFORCEMENT CLAMP

(71) Applicant: Timothy Carrick, Huntsville, AL (US)

(72) Inventor: Timothy Carrick, Huntsville, AL (US)

( * ) Notice: Subject to any disclaimer, the term of this patent is extended or adjusted under 35 U.S.C. 154(b) by 185 days.

(21) Appl. No.: 18/402,863

(22) Filed: Jan. 3, 2024

(51) Int. Cl.
*A47C 7/00* (2006.01)

(52) U.S. Cl.
CPC ..... *A47C 7/002* (2013.01)

(58) Field of Classification Search
CPC ..... A47C 7/002; A47C 7/02; A47C 7/00
See application file for complete search history.

(56) References Cited

U.S. PATENT DOCUMENTS

| | | | | |
|---|---|---|---|---|
| 4,047,752 | A | 9/1977 | Rohr | |
| 6,390,551 | B1 * | 5/2002 | Hendrickson | A47C 1/16 297/250.1 |
| 6,871,905 | B2 | 3/2005 | Grace | |
| 7,128,369 | B2 * | 10/2006 | Boggs | A47C 1/14 297/352 |
| 7,401,850 | B2 | 7/2008 | Micheel | |
| 7,717,503 | B1 * | 5/2010 | Watson | A47C 4/286 297/16.2 |
| 8,066,323 | B2 | 11/2011 | McCabe | |
| 9,596,938 | B2 | 3/2017 | Le | |
| 9,723,930 | B2 * | 8/2017 | Burch | A47C 7/725 |
| 10,292,501 | B1 * | 5/2019 | Brown | A47C 7/506 |
| 11,044,998 | B1 * | 6/2021 | Garcia | B65D 81/18 |
| 2005/0225151 | A1 * | 10/2005 | Zenisek | A47C 12/00 297/423.19 |
| 2014/0123455 | A1 * | 5/2014 | Mishica | A47C 4/286 29/401.1 |
| 2014/0239676 | A1 * | 8/2014 | Yagi | A47C 1/0352 297/75 |
| 2014/0339859 | A1 * | 11/2014 | Holland | A47C 4/286 297/19 |
| 2014/0346818 | A1 * | 11/2014 | Yang | A47C 4/286 297/16.2 |
| 2016/0128482 | A1 * | 5/2016 | Wallace | A47C 1/11 297/183.1 |
| 2020/0113338 | A1 * | 4/2020 | Perez | A47C 3/34 |

FOREIGN PATENT DOCUMENTS

| | | |
|---|---|---|
| GB | 1510285 | 5/1976 |

* cited by examiner

*Primary Examiner* — Chi Q Nguyen
(74) *Attorney, Agent, or Firm* — Kyle A. Fletcher, Esq.

(57) ABSTRACT

A leg reinforcement clamp is an accessory for a chair. The leg reinforcement clamp incorporates a chair structure, a base structure, and a lid structure. The chair structure further incorporates a first gusset structure and a second gusset structure. The first gusset structure and the second gusset structure are load bearing structures. The first gusset structure and the second gusset structure forms a load path that transfers a portion of the load borne by the bench to a supporting surface. The lid structure attaches to the base structure. The lid structure encloses the first gusset structure and the second gusset structure within the base structure. The base structure and the lid structure combine to brace the first gusset structure to the second gusset structure.

11 Claims, 7 Drawing Sheets

122 { 171, 172, 173, 171 }

163 { 191, 192, 193, 194 }

113 { 151, 152, 153, 154 }

133 { 181, 182, 183, 184 }

LEG REINFORCEMENT CLAMP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of parts, details, and accessories for chairs and stools. (A47C7/00)

SUMMARY OF INVENTION

The leg reinforcement clamp is an accessory for a chair. The leg reinforcement clamp comprises a chair structure, a base structure, and a lid structure. The chair structure further comprises a first gusset structure and a second gusset structure. The first gusset structure and the second gusset structure are load bearing structures. The first gusset structure and the second gusset structure forms a load path that transfers a portion of the load borne by the bench to a supporting surface. The lid structure attaches to the base structure. The lid structure encloses the first gusset structure and the second gusset structure within the base structure. The base structure and the lid structure combine to brace the first gusset structure to the second gusset structure. These together with additional objects, features and advantages of the leg reinforcement clamp will be readily apparent to those of ordinary skill in the art upon reading the following detailed description of the presently preferred, but nonetheless illustrative, embodiments when taken in conjunction with the accompanying drawings.

In this respect, before explaining the current embodiments of the leg reinforcement clamp in detail, it is to be understood that the leg reinforcement clamp is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the leg reinforcement clamp.

It is therefore important that the claims be regarded as including such equivalent construction insofar as they do not depart from the spirit and scope of the leg reinforcement clamp. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
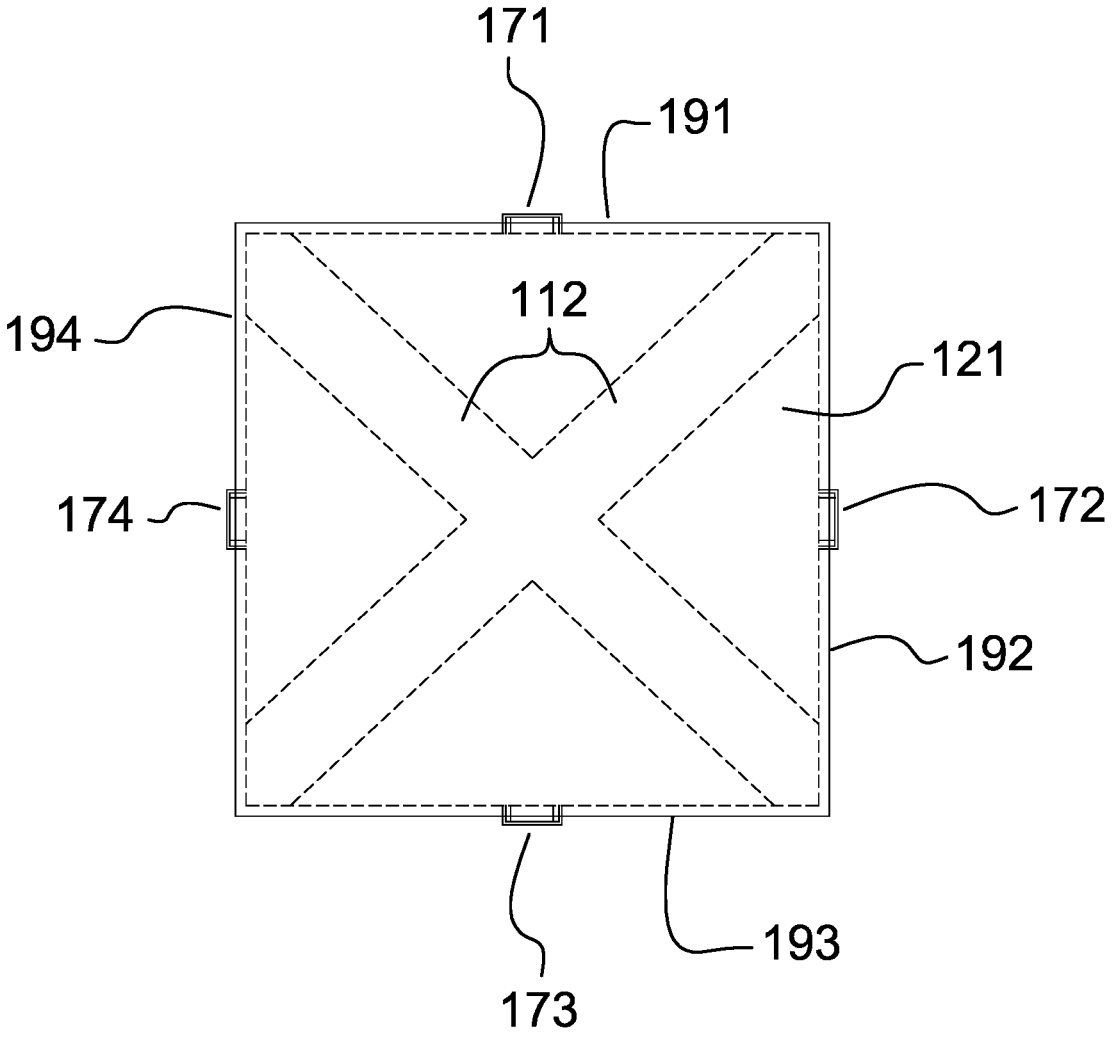
FIG. 1 is a front view of an embodiment of the disclosure.
Figure 2:
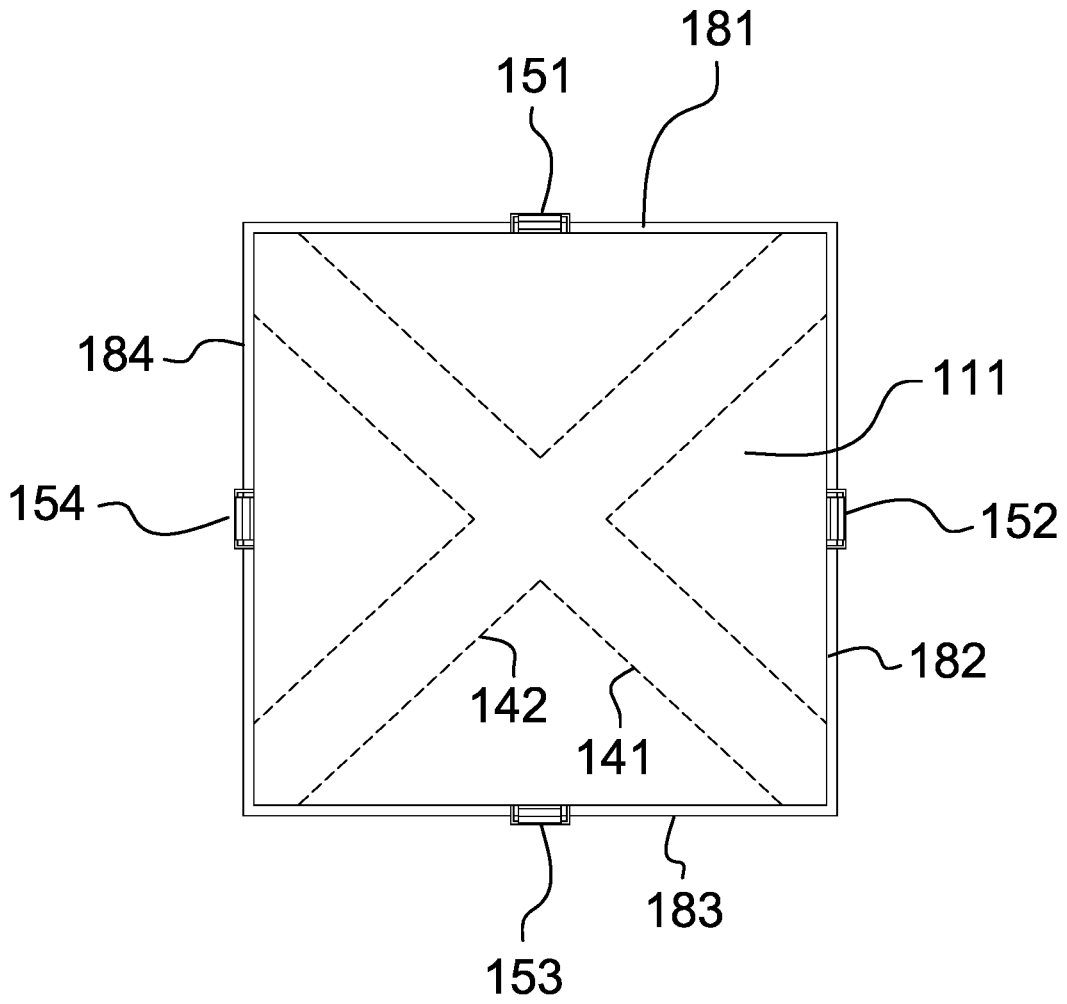
FIG. 2 is a rear view of an embodiment of the disclosure.
Figure 3:
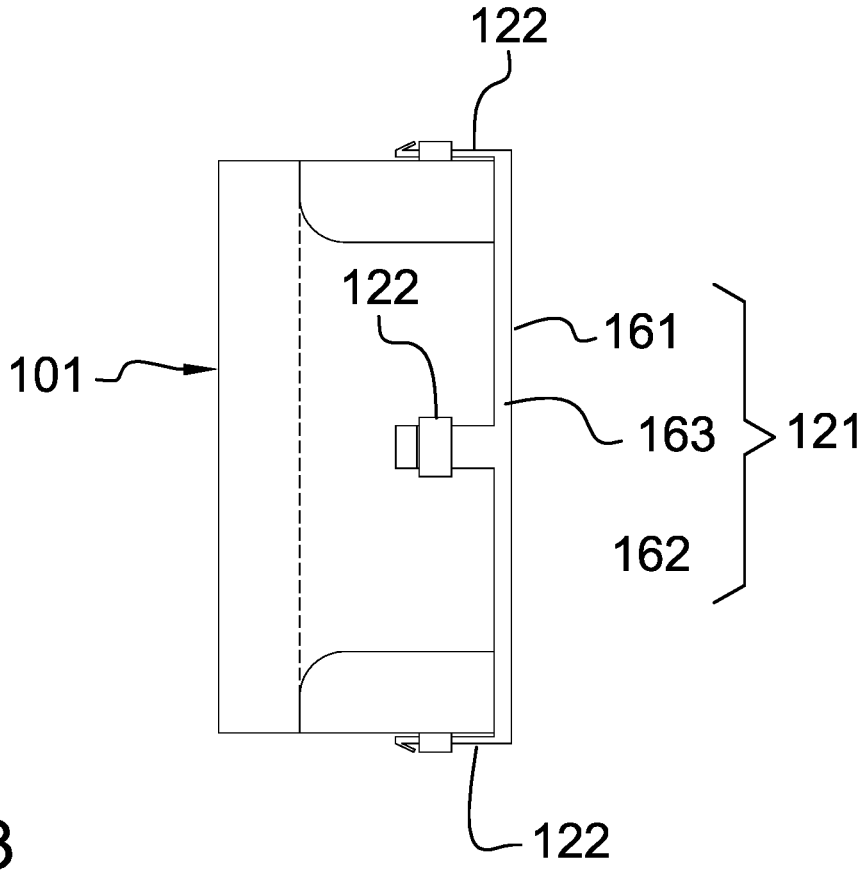
FIG. 3 is a lateral view of an embodiment of the disclosure.
Figure 4:
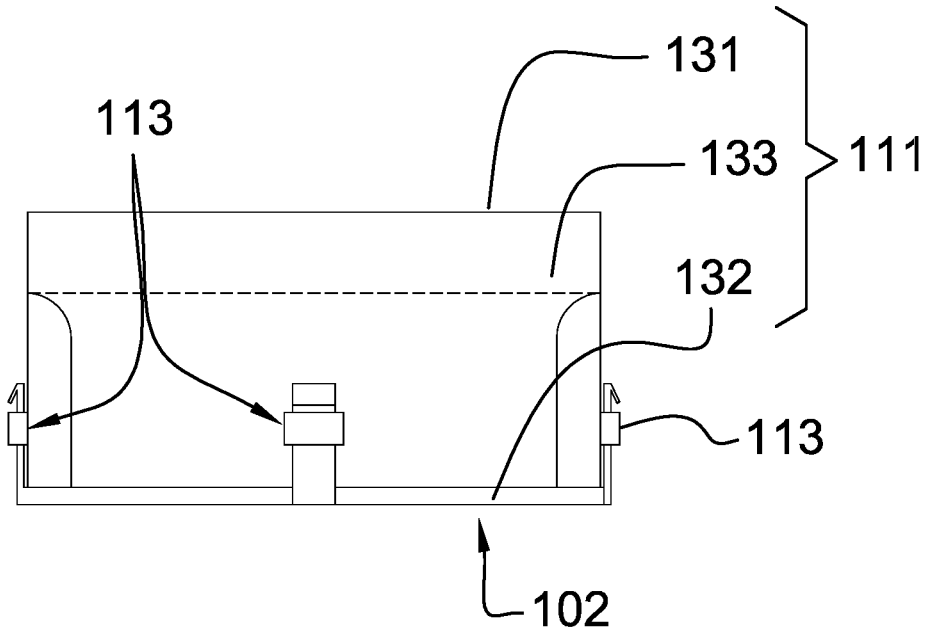
FIG. 4 is a lateral view of an embodiment of the disclosure.
Figure 5:
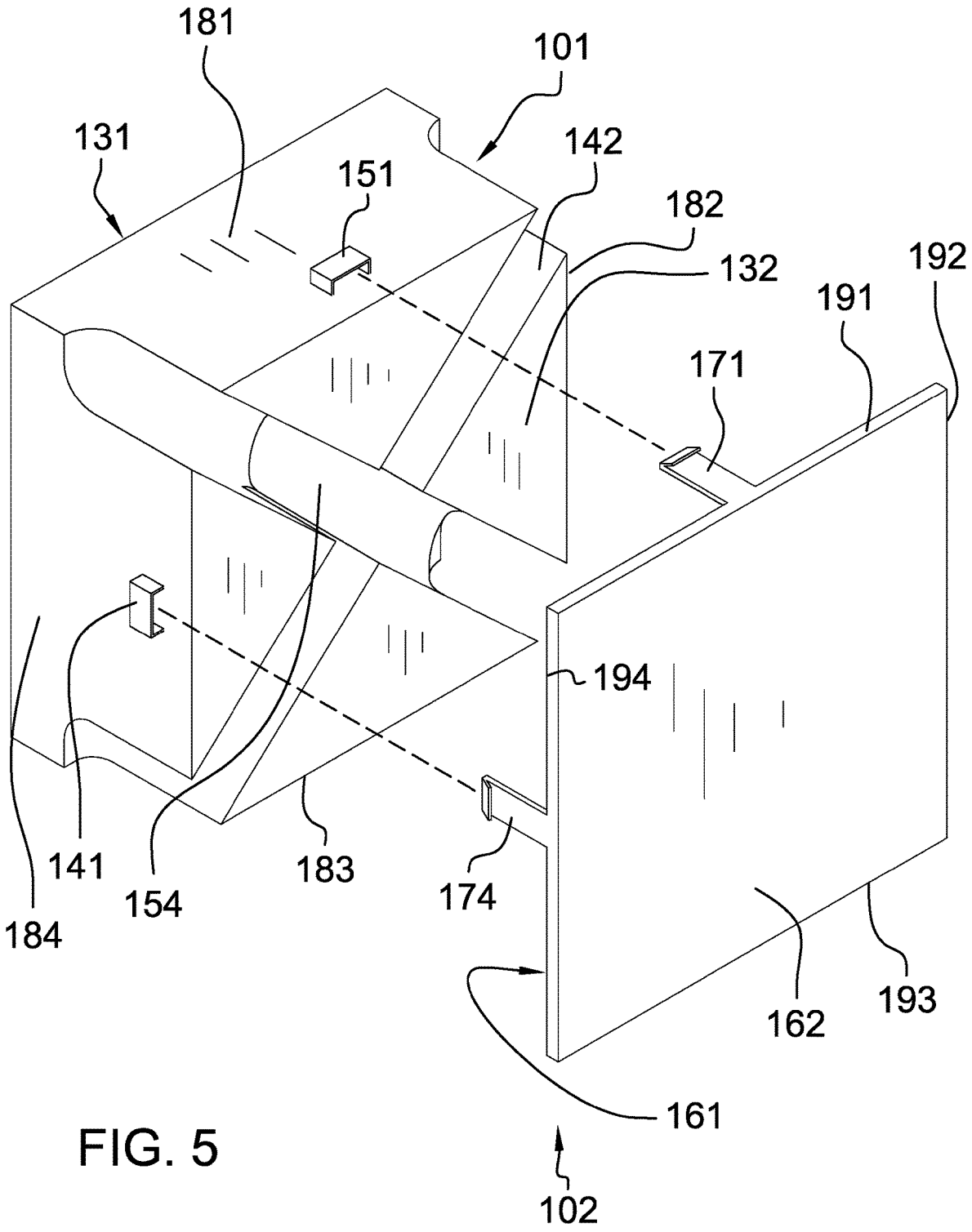
FIG. 5 is an exploded view of an embodiment of the disclosure.
Figure 6:
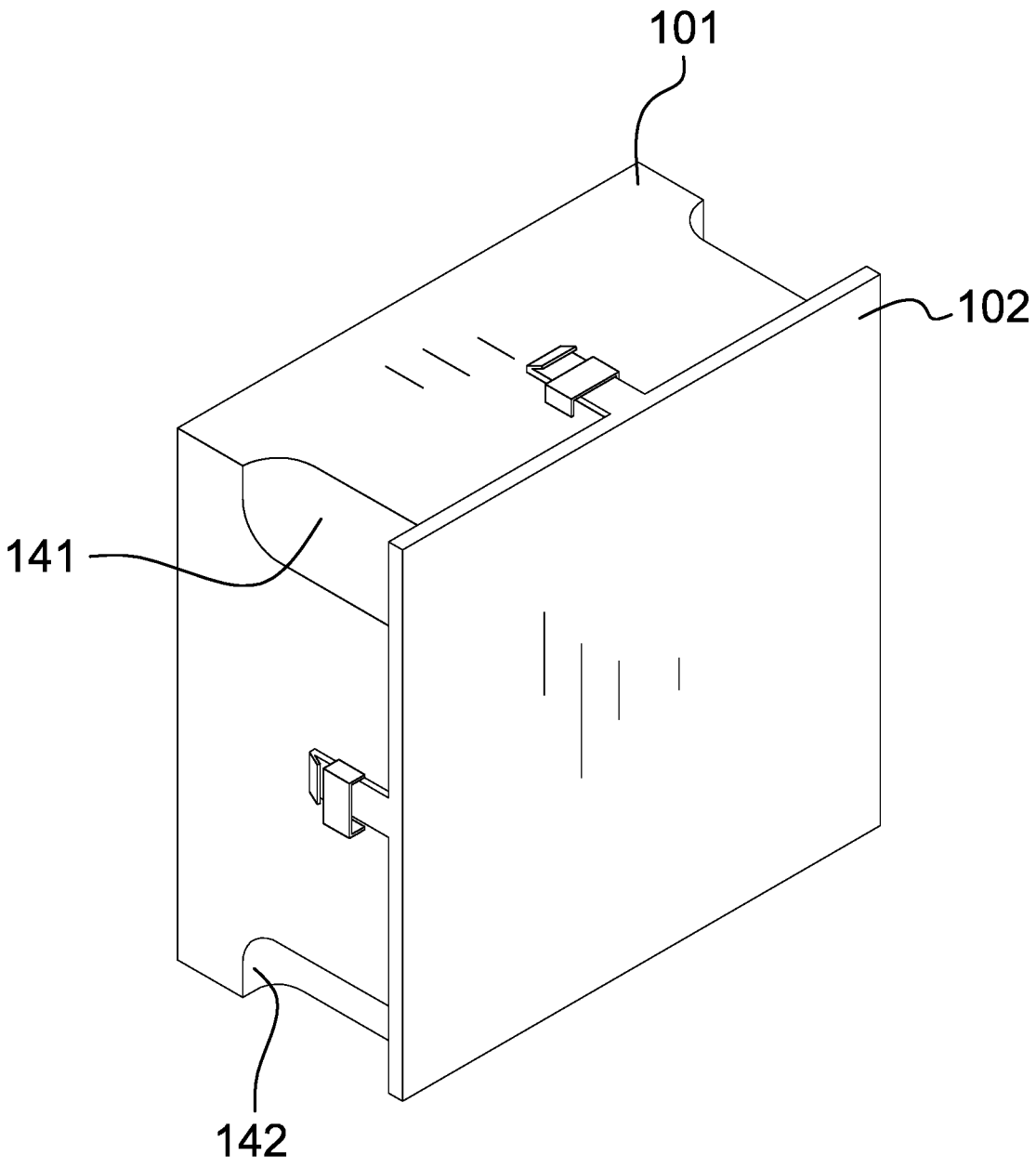
FIG. 6 is a perspective view of an embodiment of the disclosure.
Figure 7:
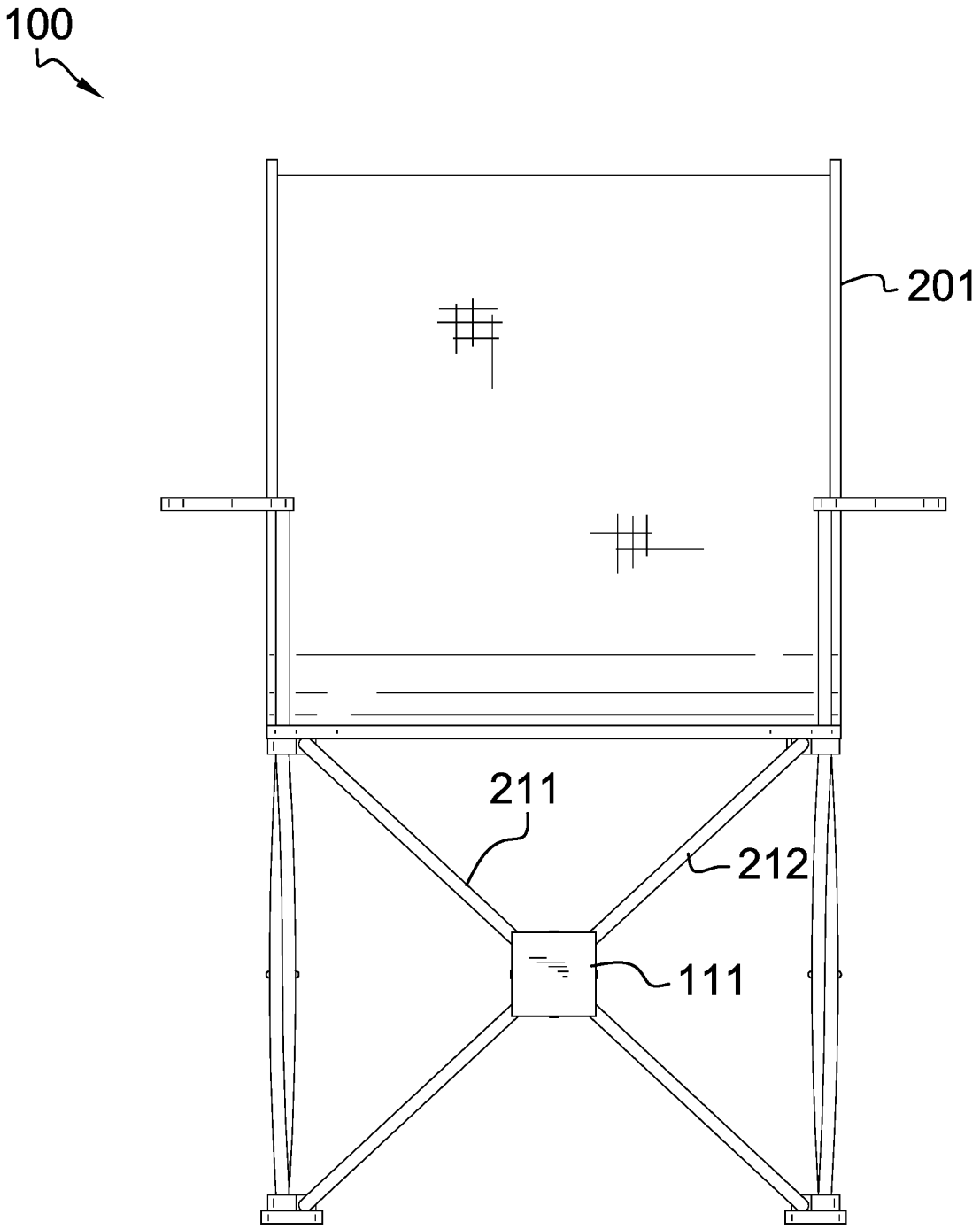
FIG. 7 is an in-use view of an embodiment of the disclosure.
Figure 8:
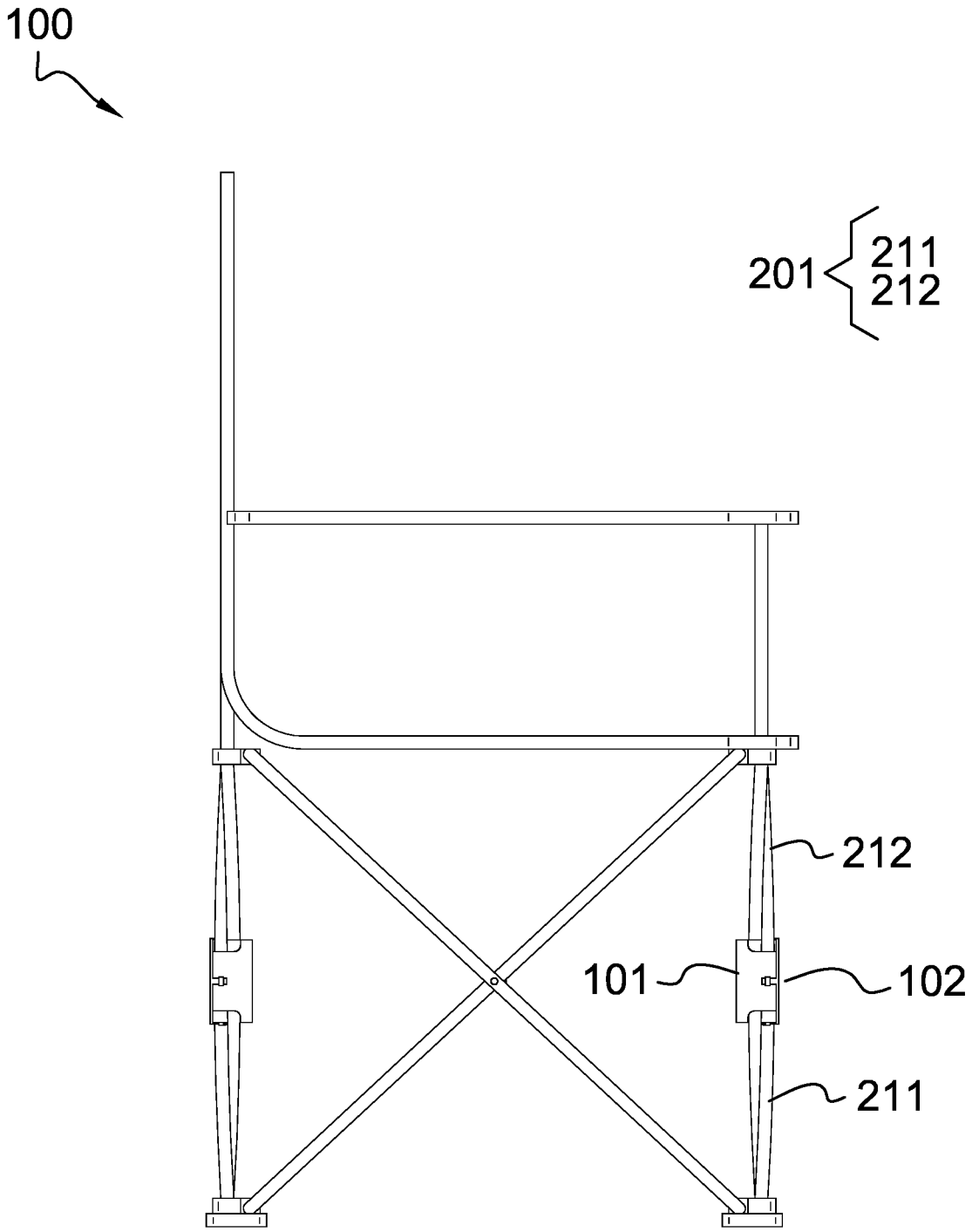
FIG. 8 is an in-use view of an embodiment of the disclosure.

Detailed reference will now be made to one or more potential embodiments of the disclosure, which are illustrated in FIGS. 1 through 8.

The leg reinforcement clamp 100 (hereinafter invention) is an accessory for a chair. The invention 100 comprises a chair structure 201, a base structure 101, and a lid structure 102. The chair structure 201 further comprises a first gusset structure 211 and a second gusset structure 212. The first gusset structure 211 and the second gusset structure 212 are load bearing structures. The first gusset structure 211 and the second gusset structure 212 forms a load path that transfers a portion of the load borne by the bench to a supporting surface. The lid structure 102 attaches to the base structure 101. The lid structure 102 encloses the first gusset structure 211 and the second gusset structure 212 within the base structure 101. The base structure 101 and the lid structure 102 combine to brace the first gusset structure 211 to the second gusset structure 212.

The chair structure 201 is a chair. The chair is defined elsewhere in this disclosure. The chair structure 201 comprises a first gusset structure 211 and a second gusset structure 212. The first gusset structure 211 is a prism shaped structure. The first gusset structure 211 is a rigid structure. The first gusset structure 211 is a load bearing structure. The first gusset structure 211 forms a load path that transfers a portion of the load borne by the bench of the chair structure 201 to the supporting surface. The second gusset structure 212 is a prism shaped structure. The second gusset structure 212 is a rigid structure. The second gusset structure 212 is a load bearing structure. The second gusset structure 212 forms a load path that transfers a portion of the load borne by the bench of the chair structure 201 to the supporting surface.

The base structure 101 is a roughly prism shaped structure. The base structure 101 has the primary shape of a rectangular block. The base structure 101 is a rigid structure. The base structure 101 is a load bearing structure. The base structure forms the structure of the invention 100 that receives the first gusset structure 211 and the second gusset structure 212. The first gusset structure 211 inserts into the base structure 101. The second gusset structure 212 inserts into the base structure 101 such that the second gusset structure 212 overlays the first gusset structure 211. The base structure 101 comprises a base block 111, a plurality of face channels 112, and a plurality of base latch structures 113.

The base block 111 is a prism shaped structure. The base block 111 is a rigid structure. The base block 111 has the primary shape of a rectangular block. The base block 111 is a load bearing structure. The plurality of face channels 112 are formed in the base block 111. The plurality of base latch structures 113 attach to the base block 111. The base block 111 forms the physical structure that braces the second gusset structure 212 to the first gusset structure 211.

The base block 111 comprises an exterior base congruent end 131, an interior base congruent end 132, and a plurality of base lateral faces 133.

The interior base congruent end 132 is a congruent end of the prism structure of the base block 111. The interior base congruent end 132 is the face of the base block 111 that receives the plurality of face channels 112. The interior base congruent end 132 is the face of the base block 111 that is proximal to the lid structure 102 when the lid structure 102 attaches to the base structure 101. The exterior base congruent end 131 is a congruent end of the prism structure of the base block 111. The exterior base congruent end 131 is the face of the base block 111 that is distal from the interior base congruent end 132.

The plurality of base lateral faces 133 forms the lateral face structure of the prism shape of the base block 111. The plurality of base lateral faces 133 form a portion of the outer surfaces of the base block 111. The plurality of base lateral faces 133 form the perimeters of the exterior base congruent end 131 and the interior base congruent end 132.

Each face channel selected from the plurality of face channels 112 is a prism shaped negative space. Each selected face channel is formed in the interior base congruent end 132 of the base block 111. Each selected face channel receives a gusset structure selected from the group consisting of the first gusset structure 211 and the second gusset structure 212. Each selected face channel is a fitted structure. By fitted is meant that the interior surface of the selected face channel is geometrically identical to a portion of the exterior surface of the selected gusset structure such that the selected gusset structure sits flush within the selected face channel.

Each face channel selected from the plurality of face channels 112 is positioned in the interior base congruent end 132 of the base block 111 such that the center point of the center axis of the selected face channel lies on the center axis of the prism structure of the base block 111. Each selected face channel is further positioned such that the center axis of the selected face channel intersects with an initially selected brink formed between two adjacent base lateral faces selected from the plurality of base lateral faces 133. The plurality of face channels 112 are further positioned such that the center axis of the selected face channel intersects with a subsequently selected brink formed between two adjacent base lateral faces selected from the plurality of base lateral faces 133. Each base latch structure selected from the plurality of base latch structures 113 is a component of a fastening device.

Each base latch structure selected from the plurality of base latch structures 113 mounts on a base lateral face selected from the plurality of base lateral faces 133. Each selected base latch structure forms an anchor point that secures the lid disk structure 102 to the base structure 101.

The lid structure 102 has the primary shape of a disk. The congruent ends of the disk structure of the lid structure 102 are geometrically identical to the interior base congruent end 132 of the base structure 101. The lid structure 102 removably attaches to the base structure 101. The lid structure 102 aligns with the interior base congruent end 132. The lid structure 102 encloses the interior base congruent end 132. The lid structure 102 comprises a lid disk structure 121 and a plurality of lid latch structures 122.

The lid disk structure 121 is a disk shaped structure. The lid disk structure 121 is a rigid structure. The lid disk structure 121 is a load bearing structure. The plurality of lid latch structures 122 attach to the lid disk structure 121. The congruent ends of the disk structure of the lid disk structure are geometrically identical to the interior base congruent end 132 of the base block 111. The lid structure 102 attaches to the base structure 101 such that the lid disk structure 121 aligns with the interior base congruent end 132 of the base block 111. The lid disk structure 121 encloses the interior base congruent end 132.

Each lid latch structure selected from the plurality of lid latch structures 122 is a component of a fastening device. Each lid latch structure selected from the plurality of lid latch structures 122 mounts on a lid lateral face selected from the plurality of lid lateral faces 163. Each lid latch structure selected from the plurality of lid latch structures 122 is associated with a base latch structure selected from the plurality of base latch structures 113. The lid structure 102 removably attaches the base structure 101 by securing each selected lid latch structure to its associated selected base latch structure.

The lid disk structure 121 comprises an exterior lid congruent end 161, an interior lid congruent end 162, and a plurality of lid lateral faces 163.

The interior lid congruent end 162 is a congruent end of the disk structure of the lid disk structure 121. The interior lid congruent end 162 is the congruent end of the lid disk structure 121 that rests against the interior base congruent end of the base structure 101 when the lid structure 102 attaches to the base structure 101. The exterior lid congruent end 161 is a congruent end of the disk structure of the lid disk structure 121. The exterior lid congruent end 161 is the face of the lid disk structure 121 that is distal from the interior lid congruent end 162.

The plurality of lid lateral faces 163 forms the lateral face structure of the disk shape of the lid disk structure 121. The plurality of lid lateral faces 163 form the perimeters of the exterior lid congruent end 161 and the interior lid congruent end 162. Each lid latch structure selected from the plurality of lid latch structures 122 attaches to a lid lateral face selected from the plurality of lid lateral faces 163.

The plurality of base lateral faces 133 further comprises a first base lateral face 181, a second base lateral face 182, a third base lateral face 183, and a fourth base lateral face 184. The first base lateral face 181 is an initial base lateral face selected from the plurality of base lateral faces 133. The third base lateral face 183 is the base lateral face selected from the plurality of base lateral faces 133 that is distal from the first base lateral face 181. The second base lateral face 182 is a base lateral face selected from the plurality of base lateral faces 133. The second base lateral face 182 forms a brink with the first base lateral face 181. The second base lateral face 182 forms a brink with the third base lateral face 183. The fourth base lateral face 184 is the base lateral face selected from the plurality of base lateral faces 133 that is distal from the second base lateral face 182. The fourth base lateral face 184 forms a brink with the first base lateral face 181. The fourth base lateral face 184 forms a brink with the third base lateral face 183.

The plurality of face channels 112 comprises a first face channel 141 and a second face channel 142.

The first face channel 141 is the face channel selected from the plurality of face channels 112 that is sized to receive the first gusset structure 211 of the chair structure 201. The first face channel 141 is positioned such that the center axis of the first face channel 141 intersects with the brink formed between the fourth base lateral face 184 and the first base lateral face 181 of the base block 111. The first face channel 141 is positioned such that the center axis of the first face channel 141 further intersects with the brink formed between the second base lateral face 182 and the third base lateral face 183 of the base block 111. The position of the center axis of the first face channel 141 is deep relative to the center axis of the second face channel 142.

The second face channel 142 is the face channel selected from the plurality of face channels 112 that is sized to receive the first gusset structure 211 of the chair structure 201. The second face channel 142 is positioned such that the center axis of the second face channel 142 intersects with the brink formed between the first base lateral face 181 and the second base lateral face 182 of the base block 111. The second face channel 142 is positioned such that the center axis of the second face channel 142 further intersects with the brink formed between the third base lateral face 183 and the fourth base lateral face 184 of the base block 111. The position of the center axis of the second face channel 142 is shallow relative to center axis of the first face channel 141.

The center axes of the first face channel 141 and the second face channel 142 cross each other at the center axis of the prism structure of the base block 111.

The first gusset structure 211 rests in the first face channel 141 such that the lid disk structure 121 encloses the first gusset structure 211 within the first face channel 141. The second gusset structure 212 rests in the second face channel such that the lid disk structure 121 encloses the second gusset structure 212 within the second face channel 142.

The plurality of base latch structures 113 comprises a first base latch structure 151, a second base latch structure 152, a third base latch structure 153, and a fourth base latch structure 154. The first base latch structure 151 is the base latch structure selected from the plurality of base latch structures 113 that mounts on the first base lateral face 181. The second base latch structure 152 is the base latch structure selected from the plurality of base latch structures 113 that mounts on the second base lateral face 182. The third base latch structure 153 is the base latch structure selected from the plurality of base latch structures 113 that mounts on the third base lateral face 183. The fourth base latch structure 154 is the base latch structure selected from the plurality of base latch structures 113 that mounts on the fourth base lateral face 184.

The plurality of lid lateral faces 163 further comprises a first lid lateral face 191, a second lid lateral face 192, a third lid lateral face 193, and a fourth lid lateral face 194. The plurality of lid latch structures 122 comprises a first lid latch structure 171, a second lid latch structure 172, a third lid latch structure 173, and a fourth lid latch structure 174.

The first lid lateral face 191 is an initial lid lateral face selected from the plurality of lid lateral faces 163. The span of the length of the major axis of the first lid lateral face 191 is identical to the span of the length of the perimeter edge of the interior base congruent end 132 that is formed by the first base lateral face 181. The third lid lateral face 193 is the lid lateral face selected from the plurality of lid lateral faces 163 that is distal from the third base lateral face 183. The span of the length of the major axis of the third lid lateral face 193 is identical to the span of the length of the perimeter edge of the interior base congruent end 132 that is formed by the third base lateral face 183.

The second lid lateral face 192 is a lid lateral face selected from the plurality of lid lateral faces 163. The second lid lateral face 192 forms a brink with the first lid lateral face 191. The second lid lateral face 192 forms a brink with the third lid lateral face 193. The span of the length of the major axis of the second lid lateral face 192 is identical to the span of the length of the perimeter edge of the interior base congruent end 132 that is formed by the second base lateral face 182.

The fourth lid lateral face 194 is the lid lateral face selected from the plurality of lid lateral faces 163 that is distal from the second lid lateral face 192. The fourth lid lateral face 194 forms a brink with the first lid lateral face 191. The fourth lid lateral face 194 forms a brink with the third lid lateral face 193. The span of the length of the major axis of the fourth lid lateral face 194 is identical to the span of the length of the perimeter edge of the interior base congruent end 132 that is formed by the fourth base lateral face 184.

The first lid latch structure 171 is the lid latch structure selected from the plurality of lid latch structures 122 that mounts on the first lid lateral face 191. The first lid latch structure 171 attaches to the first lid lateral face such that the first lid latch structure 171 aligns with the first base latch structure 151 of the base block 111. The first lid latch structure 171 removably attaches to the first base latch structure 151 to secure the lid structure 102 to the base structure 101.

The second lid latch structure 172 is the lid latch structure selected from the plurality of lid latch structures 122 that mounts on the second lid lateral face 192. The second lid latch structure 172 attaches to the second lid lateral face such that the second lid latch structure 172 aligns with the second base latch structure 152 of the base block 111. The second lid latch structure 172 removably attaches to the second base latch structure 152 to secure the lid structure 102 to the base structure 101.

The third lid latch structure 173 is the lid latch structure selected from the plurality of lid latch structures 122 that mounts on the third lid lateral face 193. The third lid latch structure 173 attaches to the third lid lateral face 193 such that the third lid latch structure 173 aligns with the third base latch structure 153 of the base block 111. The third lid latch structure 173 removably attaches to the third base latch structure 153 to secure the lid structure 102 to the base structure 101.

The fourth lid latch structure 174 is the lid latch structure selected from the plurality of lid latch structures 122 that mounts on the fourth lid lateral face 194. The fourth lid latch structure 174 attaches to the fourth lid lateral face 194 such that the fourth lid latch structure 174 aligns with the fourth base latch structure 154 of the base block 111. The fourth lid latch structure 174 removably attaches to the fourth base latch structure 154 to secure the lid structure 102 to the base structure 101.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Barrier: As used in this disclosure, a barrier is a physical obstacle that forms a boundary between a first space and a second space. The barrier prevents the passage of an object between the first space and the second space.

Brace: As used in this disclosure, a brace is a rigid structural element that interconnects a first object with a second object to form a resulting object. The brace forms an energy transfer structure that transfers, distributes, and shares a force acting on the first object between the first object and the second object. The brace is used to support, stabilize, or otherwise steady an object.

Brink: As used in this disclosure, a brink refers to the edge or line formed by the intersection of a first plane or surface and a second plane or surface wherein a cant exists between the first plane or surface and the second plane or surface.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chair: As used in this disclosure, a chair is a structure that a person can sit on. The horizontal resting surface a person sits on is called the bench. Seat is a common synonym for a chair. A sofa refers to a chair that seats more than one person.

Clamp: As used in this disclosure, a clamp refers to a friction based structure that temporarily fastens to the one or more faces of one or more prism structures. The clamp is used: a) to attach an externally provisioned object to the lateral face of a prism structure; or, b) to press a first face of a first prism to a second face of a second prism.

Closed Position: As used in this disclosure, a closed position refers to a movable barrier structure that is in an orientation that prevents access into a protected space. The closed position is often referred to as an object being "closed."

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Depth: As used in this disclosure, elevation refers to the span of the distance between a specified structure or surface and a reference surface. When comparing two specified structures: a) the "deeper" structure is the structure with the greater span of distance from the reference surface; while, b) the "shallower" structure is the structure with the lesser span of distance from the reference surface.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Face Channel: As used in this disclosure, the face channel is a negative space that is formed in the face of a solid prism shaped structure. The negative space that forms the face channel has a prism shape that forms a hollow interior with open congruent ends and an open lateral face that provides access into the hollow interior of the face channel from the exterior of the solid prism shaped structure.

Fitted: As used in this disclosure, the term fitted refers to two geometrically similar structures wherein the smaller geometrically similar structure inserts into the larger geometrically similar structure.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Gusset: As used in this disclosure, a gusset is an angled structural member used to form a portion of the load path of section of a framework. By angled is meant that the gusset is neither parallel nor perpendicular to the force of gravity.

Interior: As used in this disclosure, the interior is used as a relational term that implies that an object is contained within the boundary of a structure or a space.

Negative Space: As used in this disclosure, negative space is a method of defining an object through the use of open or empty space as the definition of the object itself, or, through the use of open or empty space to describe the boundaries of an object.

Latch: As used in this disclosure, a latch is a fastening or locking mechanism commonly used to secure a lid, a door, or, a gate in a closed position.

Lid: As used in this disclosure, a lid is a removable cover that is placed over an opening of a hollow structure to enclose the hollow structure.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis forms the longest symmetric bifurcation of a structure selected from the group consisting of: a) the structure; or, b) the perimetrical boundary of the structure. The major and minor axes intersect at the center of the structure. The major axis is always parallel or perpendicular to an edge of a rectangular or rectilinear structure.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Overlay: As used in this disclosure, an overlay refers to the placement of a second structure over a first structure such that a portion of the first structure is visible through or around the second structure.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between a supporting surface and an object, structure, or other load path.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored.

The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Rectangle: As used in this disclosure, a rectangle is an enclosed four sided geometric structure. Each angle formed by the rectangle is a right angle. A non-Euclidean rectangle is a rectangle that is formed on a non-Euclidean plane.

Rectangular Block: As used in this disclosure, a rectangular block refers to a three-dimensional prism structure comprising six rectangular surfaces (commonly called faces) formed at right angles. Within this disclosure, a rectangular block may further comprise rounded edges and corners.

Roughly: As used in this disclosure, roughly refers to a comparison between two objects. Roughly means that the difference between one or more parameters of the two compared objects are not significantly different.

Stanchion: As used in this disclosure, a stanchion refers to a vertically oriented prism-shaped pole, post, or support.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Vertex: As used in this disclosure, a vertex (plural vertices) is an angle that is formed by two lines (or a plurality of surfaces) that form a point. Vertices are commonly found in polygons, prisms and pyramids.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A leg reinforcement clamp comprising
- a chair structure, a base structure, and a lid structure;
- wherein the chair structure further comprises a first gusset structure and a second gusset structure;
- wherein the first gusset structure and the second gusset structure are load bearing structures;
- wherein the first gusset structure and the second gusset structure form a load path that transfers a portion of a load borne by a bench to a supporting surface;
- wherein the lid structure attaches to the base structure;
- wherein the lid structure encloses the first gusset structure and the second gusset structure within the base structure;
- wherein the base structure and the lid structure combine to brace the first gusset structure to the second gusset structure.

2. The leg reinforcement clamp according to claim 1
- wherein the first gusset structure is a rigid structure;
- wherein the second gusset structure is a rigid structure.

3. The leg reinforcement clamp according to claim 2
- wherein the base structure has the primary shape of a rectangular block;
- wherein the base structure is a rigid structure;
- wherein the base structure is a load bearing structure;
- wherein the base structure forms the structure of the leg reinforcement clamp that receives the first gusset structure and the second gusset structure;
- wherein the first gusset structure inserts into the base structure;
- wherein the second gusset structure inserts into the base structure such that the second gusset structure overlays the first gusset structure.

4. The leg reinforcement clamp according to claim 3
- wherein the base structure comprises a base block, a plurality of face channels, and a plurality of base latch structures;
- wherein the plurality of face channels are formed in the base block;
- wherein the plurality of base latch structures attach to the base block.

5. The leg reinforcement clamp according to claim 4
- wherein the base block is a rigid structure;
- wherein the base block has the primary shape of a rectangular block;
- wherein the base block is a load bearing structure;
- wherein the base block forms a physical structure that braces the second gusset structure to the first gusset structure;
- wherein the base block comprises an exterior base congruent end, an interior base congruent end, and a plurality of base lateral faces;
- wherein the interior base congruent end is a congruent end of the base block;
- wherein the interior base congruent end is the face of the base block that receives the plurality of face channels;
- wherein the interior base congruent end is the face of the base block that is proximal to the lid structure when the lid structure attaches to the base structure;
- wherein the exterior base congruent end is a congruent end of the base block;
- wherein the exterior base congruent end is the face of the base block that is distal from the interior base congruent end;
- wherein the plurality of base lateral faces form the lateral face structure of the base block;
- wherein the plurality of base lateral faces form a portion of the outer surfaces of the base block;
- wherein the plurality of base lateral faces form the perimeters of the exterior base congruent end and the interior base congruent end.

6. The leg reinforcement clamp according to claim 5
- wherein each face channel selected from the plurality of face channels is a negative space;
- wherein each selected face channel is formed in the interior base congruent end of the base block;
- wherein each selected face channel receives a gusset structure selected from a group consisting of the first gusset structure and the second gusset structure;
- wherein each selected face channel is a fitted structure;
- wherein by fitted is meant that the interior surface of the selected face channel is geometrically identical to a portion of the exterior surface of the selected gusset structure such that the selected gusset structure sits flush within the selected face channel;

wherein each face channel selected from the plurality of face channels is positioned in the interior base congruent end of the base block such that the center point of the center axis of the selected face channel lies on the center axis of the base block;

wherein each selected face channel is further positioned such that the center axis of the selected face channel intersects with an initially selected brink formed between two adjacent base lateral faces selected from the plurality of base lateral faces;

wherein the plurality of face channels are further positioned such that the center axis of the selected face channel intersects with a subsequently selected brink formed between two adjacent base lateral faces selected from the plurality of base lateral faces.

7. The leg reinforcement clamp according to claim 6 wherein each base latch structure selected from the plurality of base latch structures is a component of a fastening device;

wherein each base latch structure selected from the plurality of base latch structures mounts on a base lateral face selected from the plurality of base lateral faces;

wherein each selected base latch structure forms an anchor point that secures the lid structure to the base structure.

8. The leg reinforcement clamp according to claim 7 wherein the lid structure has the primary shape of a disk;

wherein the congruent ends of the disk structure of the lid structure are geometrically identical to the interior base congruent end of the base structure;

wherein the lid structure removably attaches to the base structure;

wherein the lid structure aligns with the interior base congruent end;

wherein the lid structure encloses the interior base congruent end.

9. The leg reinforcement clamp according to claim 8 wherein the lid structure comprises a lid disk structure and a plurality of lid latch structures;

wherein each lid latch structure selected from the plurality of lid latch structures mounts the lid disk structure.

10. The leg reinforcement clamp according to claim 9 wherein the lid disk structure is a disk shaped structure;

wherein the lid disk structure is a rigid structure;

wherein the lid disk structure is a load bearing structure;

wherein the plurality of lid latch structures attach to the lid disk structure;

wherein the congruent ends of the disk structure of the lid disk structure are geometrically identical to the interior base congruent end of the base block;

wherein the lid disk structure attaches to the base structure such that the lid disk structure aligns with the interior base congruent end of the base block;

wherein the lid disk structure encloses the interior base congruent end;

wherein the lid disk structure comprises an exterior lid congruent end, an interior lid congruent end, and a plurality of lid lateral faces;

wherein the interior lid congruent end is a congruent end of the disk structure of the lid disk structure;

wherein the interior lid congruent end is the congruent end of the lid disk structure that rests against the interior base congruent end of the base structure when the lid structure attaches to the base structure;

wherein the exterior lid congruent end is a congruent end of the disk structure of the lid disk structure;

wherein the exterior lid congruent end is the face of the lid disk structure that is distal from the interior lid congruent end;

wherein the plurality of lid lateral faces forms the lateral face structure of the disk shape of the lid disk structure;

wherein the plurality of lid lateral faces form the perimeters of the exterior lid congruent end and the interior lid congruent end.

11. The leg reinforcement clamp according to claim 10 wherein each lid latch structure selected from the plurality of lid latch structures is a component of a fastening device;

wherein each lid latch structure selected from the plurality of lid latch structures mounts on a lid lateral face selected from the plurality of lid lateral faces;

wherein each lid latch structure selected from the plurality of lid latch structures is associated with a base latch structure selected from the plurality of base latch structures;

wherein the lid structure removably attaches the base structure by securing each selected lid latch structure to its associated selected base latch structure, wherein each lid latch structure selected from the plurality of lid latch structures attaches to a lid lateral face selected from the plurality of lid lateral faces.

* * * * *